United States Patent [19]

Tsushima et al.

[11] Patent Number: 4,718,782

[45] Date of Patent: Jan. 12, 1988

[54] THERMAL PRINTER

[75] Inventors: Mitsuo Tsushima, Iwate; Hiroshi Abe, Iwaki, both of Japan

[73] Assignee: Alps Electric Co., Ltd., Japan

[21] Appl. No.: 943,383

[22] Filed: Dec. 17, 1986

[30] Foreign Application Priority Data

Jan. 30, 1986 [JP] Japan ..... 61-10947

[51] Int. Cl.[4] ..... B41J 11/08

[52] U.S. Cl. ..... 400/23; 400/578; 400/642

[58] Field of Search ..... 400/578, 600, 642, 23, 400/29, 36, 595, 600.2, 600.4, 624; 235/58 CF, 58 CW, 55 P, 101

[56] References Cited

U.S. PATENT DOCUMENTS

| | | | |
|---|---|---|---|
| 3,334,722 | 8/1967 | Bernard | 400/613.2 X |
| 3,656,602 | 4/1972 | Konkel et al. | 400/616 |
| 3,707,214 | 12/1972 | Ponzano | 400/174 X |
| 4,443,925 | 2/1984 | Fujiwara et al. | 400/88 |
| 4,562,444 | 12/1985 | Nagashima et al. | 400/578 X |
| 4,609,295 | 9/1986 | Shimodaira | 400/624 |
| 4,613,248 | 9/1986 | Iwase et al. | 400/697.1 |

FOREIGN PATENT DOCUMENTS

| | | | |
|---|---|---|---|
| 0010472 | 2/1981 | Japan | 400/88 |
| 0066988 | 4/1982 | Japan | 400/691 |

*Primary Examiner*—Edgar S. Burr
*Assistant Examiner*—Joseph McCarthy
*Attorney, Agent, or Firm*—Guy W. Shoup

[57] ABSTRACT

A printer wherein when in printing, a platen and a head are opposedly disposed by a carriage, said printer comprising a bottom plate on which said platen or said head is disposed, and a body hinged to said bottom plate and designed to include said carriage, said body and said bottom plate being relatively rotated.

2 Claims, 3 Drawing Figures

THERMAL PRINTER

BACKGROUND OF THE INVENTION

1. Field of the Invention

The present invention relates to printers, and more particularly to a printer which facilitates insertion and removal a piece of paper from an apparatus.

2. Description of the Prior Art.

FIG. 3 is a side view showing one example of a conventional printer used in personal computers, personal word processors, etc.

A feed roller 3 for transporting a paper 2 while being placed in contact with about one half of an outer peripheral surface thereof is rotatably disposed on the end of a paper guide 1 having a feed surface. A pressing roller 4 for pressing the paper 2 against the surface of the roller 3 is disposed under the roller 3. The pressing roller 4 is retained by a circular holding member 5, which is in turn secured to the bottom of the guide 1 by means of a pressing spring 6. A platen 7 for contacting a surface of the paper 2 to which printing is not applied is disposed on the paper outlet of the roller 3, and a head 8 is disposed opposedly of the platen 7. The head 8 is secured to a head mounting base 10 which rotates around a support point 9, and these elements are secured to a carriage 11.

With the arrangement as described above, the head mounting base 10 and the carriage 11 are first rotated clockwise to form a clearance between the platen 7 and the head 8. Then the paper 2 is inserted between the paper guide 1 and the feed roller 3, and the roller 3 is rotated counterclockwise. Thereby, the paper 2 is pressed against the surface of the roller 3 by the pressing roller 4 and rotates along with the roller 4 till it moves frontwardly of the head 8. The paper 2 is further moved and the end thereof is allowed to pass between the platen 7 and the head so that a predetermined length of the paper is exposed above the platen 7. Thereafter, the head mounting base 10 and the carriage 11 are rotated counterclockwise to bring the head 8 into pressure contact with the paper 2. In the case of the thermal transfer type, a ribbon is interposed between the head 8 and the paper 2. Under the condition as described above, a thermal resisting member of the head 8 is driven according to printing information, whereby the paper 2 is generated in color (in the case of thermal recording paper) or ink of the ribbon is transferred onto the paper 2 for printing.

However, in the conventional printer, insertion and removal of the paper to and from a printing position has to be made by operating a knob provided on the end of the feed roller and through a narrow clearance. This results in a complexity in printing operation. Therefore, it is difficult to enhance the efficiency of printing operation.

SUMMARY OF THE INVENTION

The present invention has been accomplished in view of the aforementioned situation. An object of the present invention is to provide a printer which can obtain a wide space required when paper is inserted and removed.

For achieving the above-described object, the present invention provides a printer wherein when in printing, a platen and a head are opposedly disposed by a carriage, said printer comprising a bottom plate on which said platen or said head is disposed, and a body hinged to said bottom plate and designed to include said carriage, said body and said bottom plate being relatively rotated.

According to the above-described arrangement, a space free from an obstacle is formed between the body and the bottom plate depending on an opening degree therebetween. Thus, it is possible to secure a wide space for insertion and removal of paper as printing proceeds.

DESCRIPTION OF THE PREFERRED EMBODIMENT

Figure 1:
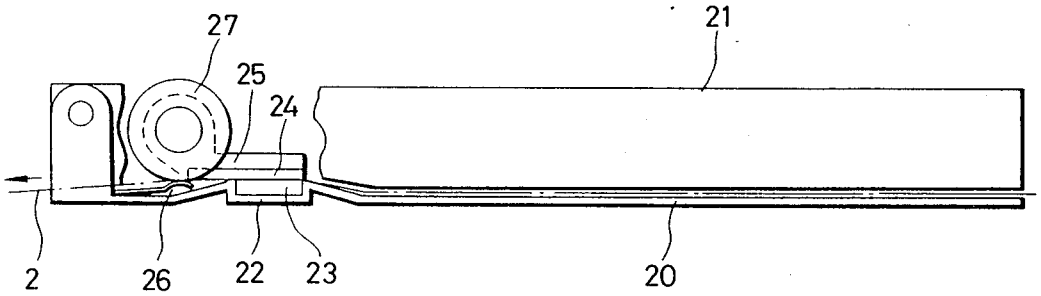
FIG. 1 is a side view showing one embodiment according to the present invention.
Figure 2:
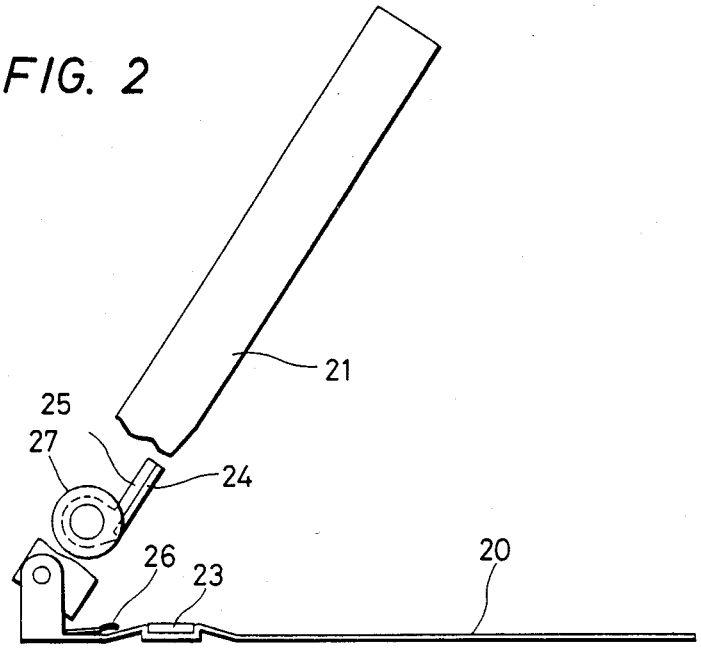
FIG. 2 is a side view showing a state where a body is opened in the embodiment shown in FIG. 1.
Figure 3:
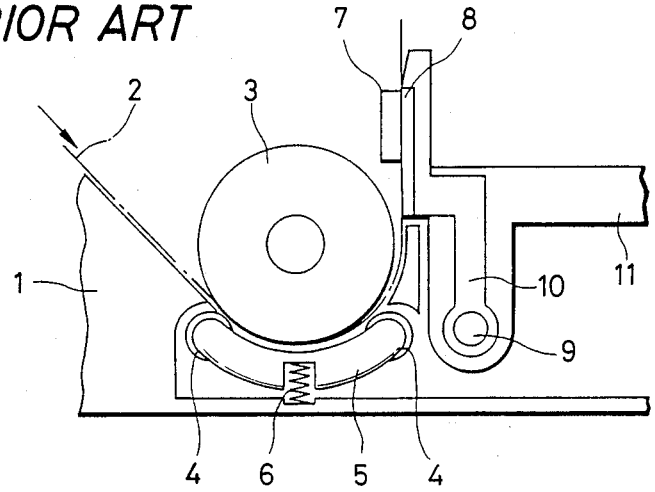
FIG. 3 PRIOR ART
FIG. 3 is a side view showing one example of a conventional printer.

Referring now to FIGS. 1 and 2, a paper guide 20 in the form of a flat plate has a body 21 hinged to the end thereof. At a predetermined position of the paper guide 20 close to the hinged portion, a recess 22 is formed at right angles to the advancing direction of the paper 2 to receive therein a platen 23. A head 24 is disposed so that it may be opposed to the platen 23 during printing. The head 24 is secured to a carriage 25, which is in turn supported at a predetermined position of a feed roller 27 and rotated within the body 21. The feed roller 27 is disposed on the body 21 in order to transport the paper according to the printing condition. The body 21 further encases therein a carriage driving mechanism for driving the carriage 25, a ribbon cassette, a ribbon winding and driving portion, etc. On the upper surface of the paper guide 20 is disposed a paper pressing spring 26 in pressure contact with a bottom plate of the feed roller 27 in the state where the body 21 is closed. The feed roller 27 is disposed parallel to the platen 23. The carriage 25 is urged clockwise by means of a spring or the like so that when printing, a printing surface of the head 24 is pressed against the surface of the platen 23 through the paper 2 and the ribbon.

With the above-described arrangement, when the paper 2 is set, the body 21 is raised to form a space with respect to the paper guide 20 which also serves as a bottom plate, as shown in FIG. 2. Under this state, the paper 2 is placed on the paper guide 20, and the paper 2 is set so that the end thereof is slightly protruded from the spring 26 (at that time, positions of left and right sides of the paper 2 are adjusted as specified). It is noted that a ribbon drawn out of a ribbon cassette is preset so as to be positioned on the undersurface of the head 24.

Thereafter, the body 21 is moved downward to assume the FIG. 1 state. Under this state, an unshown locking mechanism is actuated so that the body 21 and the paper guide 20 are connected, and at the same time the ribbon and paper are inserted and the head 24 is placed in pressure contact with the platen 23. Under this condition, the thermal resisting member is driven according to the printing information whereby ink of the ink ribbon is transferred to the paper 2 according to the content of the driving content for printing. The head 24 is moved by the carriage 25 while applying a printing to the paper 2 widthwise thereof, and is returned for printing of a next line. At the same time, the roller 27 is rotated through a predetermined amount and the head 24 again starts moving to effect printing of a next line.

As will be apparent from the foregoing, according to the above-described embodiment, the body may be opened and closed to thereby divide the feed path and printing surface into upper and lower portions. Therefore, a large space between the body 21 and the guide 20 may be secured by raising the body. As a result, the printing operation becomes facilitated to enhance the efficiency of the printing operation.

What is claimed is:

1. In a printer having a housing having a paper input side, a paper exit side, and printer components arranged in said housing including a translatable carriage, a printing head mounted on the carriage for printing on a paper, and means including a feed roller for feeding paper from the paper input side, past the printing head, and out the paper exit side, the improvement comprising:

said housing having a body portion housing said printer components, a hinge portion, and a bottom plate which is substantially planar, wherein said body portion is hinged by said hinge portion to said bottom plate at said paper exit side such that said body portion is openable rotatively away from said bottom plate to provide a wide space for insertion and removal of the paper into and from said printer; and said body portion having said printing components arranged therein such that respective paper contacting surfaces of said printing head and feed roller are substantially in one plane facing said bottom plate, and such that said feed roller is located downstream in a paper feeding direction from said printing head toward said paper exit side, and said bottom plate having provided thereon a flat paper-pressing spring member located opposite the paper contacting surface of said feed roller and a flat platen located opposite the paper contacting surface of said printing head, whereby paper can be conveniently loaded in said printer by opening said body portion away from said bottom plate, setting the paper on said bottom plate from the paper input side overlapping said spring member, then closing said body portion against said bottom plate.

2. A printer according to claim 1, wherein said bottom plate includes a shallow planar recess for holding said flat platen.

* * * * *